US005152160A

United States Patent [19]

Lentini

[11] Patent Number: 5,152,160

[45] Date of Patent: Oct. 6, 1992

[54] PADLOCK HOLDER

[76] Inventor: Michael Lentini, 2028 Camino Loma Verde, Vista, Calif. 92084

[21] Appl. No.: 779,888

[22] Filed: Oct. 21, 1991

[51] Int. Cl.[5] ..... E05B 67/38

[52] U.S. Cl. ..... 70/51; 70/54

[58] Field of Search ..... 70/51-53, 70/54-56, 417

[56] References Cited

U.S. PATENT DOCUMENTS

| | | | |
|---|---|---|---|
| 1,566,473 | 12/1925 | Gibson | 70/51 |
| 1,618,997 | 3/1927 | Radandt | 70/52 |
| 1,688,187 | 10/1928 | Jackson et al. | 70/51 |
| 2,541,638 | 2/1951 | Clevett | 70/56 |
| 3,316,795 | 5/1967 | Tann | 411/178 X |
| 3,559,429 | 2/1971 | Hermann | 70/53 |
| 3,783,657 | 1/1974 | Foote | 70/54 X |
| 3,902,339 | 9/1975 | Carley et al. | 70/54 |
| 4,277,961 | 7/1981 | Williams | 70/54 |
| 4,655,660 | 4/1987 | McGlone et al. | 411/432 X |
| 4,873,849 | 10/1989 | Goodson et al. | 70/56 X |

FOREIGN PATENT DOCUMENTS

| | | | |
|---|---|---|---|
| 877027 | 8/1971 | Canada | 70/54 |
| 381399 | 9/1923 | Fed. Rep. of Germany | 70/51 |
| 628178 | 3/1936 | Fed. Rep. of Germany | 70/51 |
| 1260582 | 2/1968 | Fed. Rep. of Germany | 70/54 |
| 3424628 | 1/1986 | Fed. Rep. of Germany | 70/52 |
| 8264 | of 1901 | United Kingdom | 70/54 |

*Primary Examiner*—Lloyd A. Gall
*Attorney, Agent, or Firm*—John J. Murphey

[57] ABSTRACT

A stabilized lock holder for a pad lock of the type including a body, containing an externally manipulative lock, and an inverted U-shaped link extending therefrom, the link defined by parallel, spaced-apart link shafts attached at one end respectively through a curved segment and adapted to be received in the body for engagement with the locking means, including a thick base adapted to fit inside the curved segment of the U-shaped link having a groove formed at least partially thereabout for receipt therein of a portion of the link and containing a surface for bearing against the body when the link is locked therein and a bore formed in the base, transverse to the plane of the U-shaped link for receipt therethrough of a shaft on which to mount the base.

1 Claim, 1 Drawing Sheet

PADLOCK HOLDER

BACKGROUND OF THE INVENTION

1. Field of the Invention

This invention relates to the field of padlocks. More particularly, this invention concerns an accessory to a padlock that is usable for mounting it in a stabilized condition during periods of non-use.

2. Description of the Prior Art

A padlock is a removable lock having a lock body, containing a locking mechanism, with an attached hinged or pivoted inverted U-shaped link adapted to be passed through a staple, chain, hasp or eye to provide security. The U-shaped link may be either completely removable from the lock body or hinged or pivoted on the body; it is often pivotable in a second direction so that the lock body may be pivoted out of the plane of the U-shaped link. The link is usually defined by parallel, spaced-apart link shafts attached at one end respectively through a curved segment with the other respective ends adapted to be received in bores formed in the lock body. The looking mechanism is externally manipulative and may contain rotatable wheels having integers or other indicia printed thereon to act as a "combination" lock or may require the insertion of a separate key to release the lock and U-shaped link. Padlocks are usually made of metal such as stainless steel, however, some are made of brass or include brass inserts. In any event, they are generally considered a work of extreme engineering beauty.

Unfortunately, as our society becomes more crowded, the general moral character of the population is declining resulting in a greater incidence of theft of personal property. To combat this condition, more and more people are resorting to locking their personal property. In some instances, such as in automobiles, the doors may be conveniently locked against intrusion to provide a substantial amount of security for the owner. In other situations, such as in bicycles and motorcycles, the lack of doors or other enclosure rules out this sort of security and the owner must resort to chaining the vehicle to a solid anchor such as a post, stanchion or a utility pole.

While padlocks perform their security service in an efficient manner, their basic construction causes problems during periods of non-use. A padlock is heavy. Its greatest mass is in the padlock body. The inverted U-shaped link, however, is usually the means by which the lock is hung or held during periods of non-use. This means that the heaviest mass of the lock is at a distance from the center of its attachment to any other object and, during periods of vibration or movement, the lock has a tendency to swing about the center curved segment of the U-shaped link allowing the body to strike nearby objects.

For instance, a specialized, heavy-duty padlock is made by Master Lock Company specifically for the Harley-Davidson Motorcycle Company to be used in securing their motorcycles during periods when they are parked and left unattended. When the user unlocks the padlock and removes the chain preparatory to using the motorcycle, a problem arises as to what to do with the padlock. Some users snap the padlock through a belt loop in their trousers and literally wear it on their person while utilizing the motorcycle. The heavy padlock body tends to swing wildly about the belt loop and strike the hip or other portions of the user's body resulting in painful contact and creating unsightly bruises. Where the lock is otherwise placed about a portion of the motorcycle body during periods of non-use, the same vibration and gyrations of the motorcycle cause the heavy padlock body to swing and contact nearby engine components resulting in dents scratches and possibly destruction of vital motorcycle parts. The padlock itself is generally too heavy to conveniently carry in one's pocket so that some means of stabilizing the padlock during periods of non-use is clearly needed.

In addition to swinging about the curved center segment of the link, the cylindrical cross section of the link shaft allows the padlock to swing in a plane orthogonal to the plane of the link, thus creating even more havoc to nearby body parts and motorcycle components. Finally, while it is possible to clamp the inverted U-shaped link tightly between a pair of spaced-apart holders, as has been done in the prior art, the holders themselves take up valuable space about the confines of the motorcycle frame and otherwise present either a personal hazard or an annoying extra in the use of the motorcycle.

SUMMARY OF THE INVENTION

This invention is a unique device that solves the aforesaid problems existing in the prior art or at least reduces them to manageable proportions. It comprises a small, lightweight stabilized lock holder for use with padlocks during periods of non-use to provide a means for mounting the padlock on a shaft utilizing the lock's own capability of locking the inverted U-shaped link down against the lock body to aid in holding the padlock stable during periods of non-use and when the motorcycle or other device on which the padlock is mounted undergoes vibration, movement or severe jolting. The invention removes the padlock from the list of those devices that may cause personal injury. It is safe, inexpensive and made of stable materials that resist the deleterious actions of vibration and those found in road environments.

The invention comprises a thick, plastic or rubber base adapted to fit inside the curved part of the inverted U-shaped link and contains a groove formed at least partially about the base for receipt therein of a portion of the link when the link is pressed down in looking engagement against the body. The base contains a surface for bearing against the body when the link is locked against it to provide stability to the holder. A bore is formed in the base transverse to the plane of the U-shaped link for receipt therethrough of a shaft, such as a bolt, on which to mount the padlock. A chamfer is formed about one end of the aperture to allow the head of the shaft or bolt to rest at least partially below the surface of the base and reduce the potential for unwanted contact with the user of the motorcycle. The invention utilizes the locking ability of the padlock itself to form part of the stabilization of the holder. The base is utilized both to stabilize the lock during periods of its non-use and, during periods of its use, is small enough that it may be easily and safely stored on the motorcycle or other vehicle.

Accordingly, the main object of this invention is a holder for a padlock that will stabilize it during periods of non-use such that it does not present a hazard to those using the vehicle or to the vehicle or components themselves. Other objects include a device that utilizes the locking ability of the padlock to form part of the stabilized mechanism of the lock holder; a holder that prevents the lock from swinging in a plane about the mounting shaft or in other directions; a holder that prevents the padlock from damaging surrounding components of a motorcycle or posing a physical hazard to the operator thereof; a holder that may be used on a wide variety of padlocks having a wide range of lengths of inverted U-shaped links; and, a holder of a padlock that reduces the potential for personal hazard of both the padlock and of the threaded shaft used to mount the padlock on the vehicle.

These and other objects of the invention will become more clear upon reading the following description of the preferred embodiment taken together with the drawings attached hereto. The scope of protection sought by the inventor herein may be gleaned from a fair reading of the claims that conclude this specification.

DESCRIPTION OF THE PREFERRED EMBODIMENT

Figure 1:
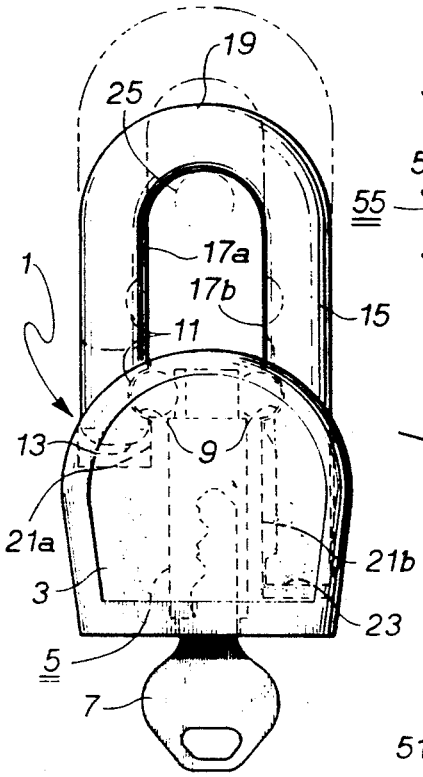
FIG. 1 is a front view of a typical padlock found in the prior art.

Turning now to the drawings wherein like elements are identified with like numerals throughout the seven figures, FIG. 1 shows a typical padlock 1 of the prior art and shows it to comprise a lock body 3 made of metal or other hard material containing interiorly thereof a locking means 5 which is generally a barrel-shaped device turnable with a locking means, such as a removable key 7, to rotate a lock-release means or ball 9 out of interfering engagement with a notch 11 formed on the releasable end 13 of an inverted U-shaped link 15. Link 15 is defined by a pair of spaced-apart, preferably parallel link shafts 17*a* and 17*b*, joined through a curved segment 19 that fit into complementary bores 21*a* and 21*b* formed in lock body 3. While some padlocks are of the construction wherein both link shafts 17*a* and 17*b* are totally releasable from lock body 3, in the prior art embodiment shown in FIG. 1, link shaft end 23 is pivotally mounted for reciprocal movement in bore 21*b* so that link 15 may be raised up partially out of lock body 3 as shown in dotted lines in FIG. 1, and may be rotated about link end 23.

Note that when padlock 1 is hung from a peg 25 or other element as shown in dotted lines in FIG. 1, the heavier lock body 3 may swing from side-to-side or, also, due to the round cross-sectional shape of link 15 be able to swing orthogonally out of the plane of lock body 3. It is this ability to swing in more than one plane that has caused personal injury and property damage when lock body 3 strikes either the person holding the lock or nearby components of the motorcycle.

Figure 2:
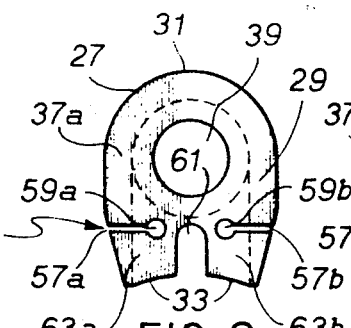
FIG. 2 is front view of the preferred embodiment of the stabilized padlock holder of this invention.
Figure 3:
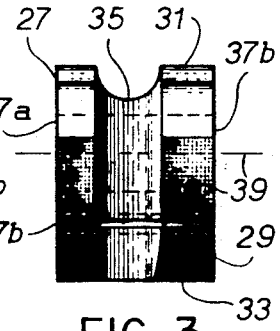
FIG. 3 is a side view of the embodiment shown in FIG. 2.
Figure 7:
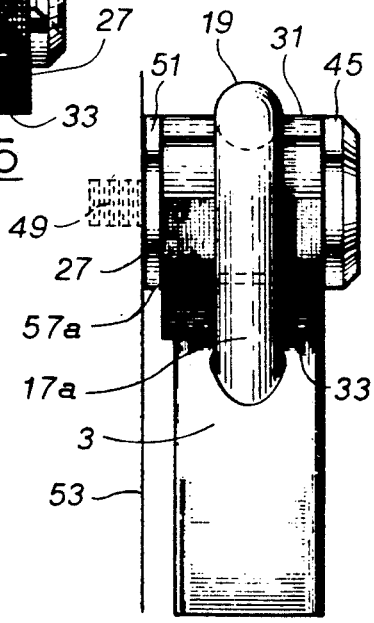

As shown in FIGS. 2 and 3, the stabilized lock-holder 27 of this invention is shown to comprise a thick base 29 having a U-shaped upper contour 31 adapted to generally follow the arcuate shape of link 15, and a lower surface 33 adapted for bearing against the upper portion of lock body 3. A groove 35 is formed about the upper surface of base 29 in contour 31 in which to partially receive curved link segment 19 and a portion of link shafts 17*a* and 17*b* as shown in FIG. 7. Groove 35 is preferably formed midway between the front and rear faces 37*a* and 37*b* respectively of base 29 so as to hold padlock 1 midway therebetween when it is locked thereagainst. Base 29 is preferably made from a hard plastic such as polyvinyl chloride, polycarbonate, or acrylonitrile-butadiene-styrene (ABS) resin or hard rubber. Such material is softer that the metal and accordingly will not scratch or tarnish the surface of padlock 1, is light enough to be placed in ones pocket when padlock 1 is placed in use as a security means, and is inert and rigorous enough to withstand vibration of the motorcycle and is resistant to the toxic and deleterious effects of gasoline, oil and other solvents generally existing in and about motorcycles and roadways.

Figure 4:
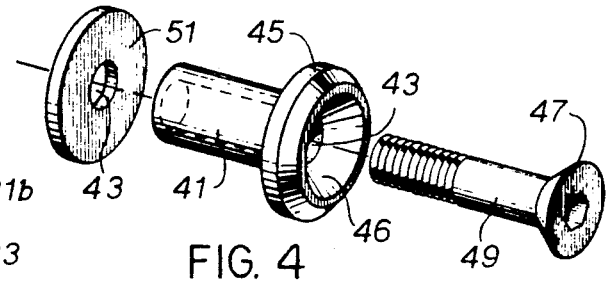
FIG. 4 is an exploded view of another embodiment showing how a bolt is insertable in an insert along with a spacing washer to mount the padlock against a solid surface.
Figure 5:
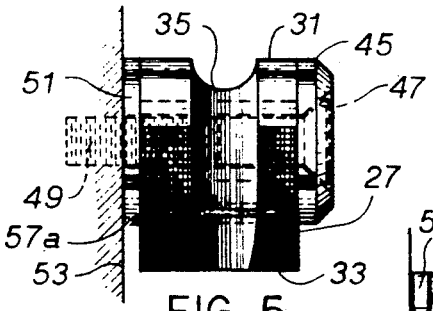
FIG. 5 is a side view of the assembled insert spacing washer and bolt shown in FIG. 4.
Figure 6:
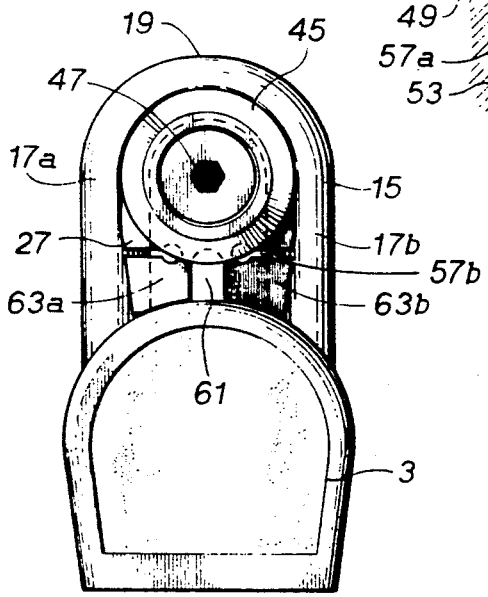
FIG. 6 is a front view of the preferred embodiment of this invention assembled together with a typical padlock for mounting against the surface; and, FIG. 7 is a side view of the embodiment shown in FIG. 6.

A bore 39 is formed in base 29, preferably in the upper portion thereof, and further preferably aligned orthogonal or transverse to the plane of inverted U-shaped link 15, passing through base faces 37*a* and 37*b*. In its most rudimentary form, as shown in FIGS. 3 and 6, said bore 39 is sized to receive therethrough the threaded shaft of an ordinary bolt used to mount said base and padlock on or about the motorcycle. In its preferred embodiment, however, bore 39 is made larger than needed for receipt of a threaded shaft and a cylindrical metal insert 41, as shown in FIGS. 4 and 5, is placed therein, said insert having its own bore 43 passing axially therethrough. This metal insert will better resist the vibrational effects of the motorcycle and reduce wear in bore 43. Insert 41 is headed by an enlarged circular portion 45 containing a counter sunk depression 46 centrally formed therein for the purpose of partially receiving the head 47 of a bolt 49 therein to prevent said bolt head from becoming a personal hazard when used in conjunction with base 29. A spacing washer 51, having a bore the same size as bore 43, is provided for assembly against base face 37*b* to provide slightly further spacing of base 29 from the surface 53 against which base 29 is mounted as shown in FIGS. 5 and 7.

A means 55 is provided in base 29 to further increase the stabilization of the lock holder of this invention. As shown in FIGS. 2 and 6, means 55 comprises a pair of spaced-apart, parallel and faced-apart first and second slots 57*a* and 57*b* formed in the sides of base 29 and extending between base faces 37*a* and 37*b*. Each of said slots 57*a* and 57*b* are terminated at their base by enlarged bores 59*a* and 59*b* respectively for the purpose of reducing the possibility that the flexing of base 29 about said slots 57*a* and 57*b* will cause cracks in said base. A third slot 61 is formed upward from base lower surface 33, intermediate and preferably midway between said enlarged bores 59*a* and 59*b* to provide a measure of flexibility to base quadrants 63*a* and 63*b* formed or at least identified by slots 57*a*, 57*b* and 61. Remembering that it is most desirable to construct base 29 of a hard plastic or rubber, means 55 permits a degree of flexibility in base 29 such that, when base 29 is placed inside of inverted U-shaped link 15 and into groove 35 and thereafter link 15 is squeezed down fast against padlock body 3, lower surface 33 of base 29 will flex into conformity with padlock body 3 thus slightly squeezing slots 57*a* and 57*b* while slightly spreading slot 61 to provide a certain degree of tightness to base 29. This further stabilizes lock holder 27 when carrying the heavy padlock during periods of nonuse.

While this invention has been described with reference to a particular embodiment thereof, those skilled in the art will be able to make various modifications to the described embodiments of the invention without departing from the true spirit and scope thereof. It is intended that all combinations of elements and steps which perform substantially the same function in substantially the same way to achieve the same results are within the scope of this invention.

What is claimed is:

1. In a pad lock of the type including a body, containing externally manipulative locking means, and an inverted U-shaped link extending therefrom, said link defined by parallel, spaced-apart link shafts attached at one end respectively through a curved segment and adapted to be received in said body for engagement with said locking means, a stabilized lock holder, comprising:

a) a thick base adapted to fit inside said curved segment of said U-shaped link having a groove formed at least partially thereabout for receipt therein of a portion of said link and containing a surface for bearing against said body when said link is locked therein; and, b) a bore formed in said base, transverse to the plane of said U-shaped link for receipt therethrough of a shaft on which to mount said base, including a hard-wearing insert for positioning in said bore to prevent said bore from wearing larger and wherein said insert is headed by an enlarged circular portion containing a chamfer centered therein to partially receive the head of a bolt therein to prevent the head of said bolt from becoming a personal hazard.

* * * * *